United States Patent [19]

Quigley et al.

[11] 3,985,258

[45] Oct. 12, 1976

[54] KNOCK-DOWN PLASTIC CONTAINER FOR PRODUCE AND THE LIKE

[76] Inventors: Patrick C. Quigley, 1110 Polynesia Drive, Foster City, Calif. 94404; James C. Chamberlin, N5512 Drumheller, Spokane, Wash. 99208

[22] Filed: Oct. 1, 1975

[21] Appl. No.: 618,443

[52] U.S. Cl. ..... 220/4 F; 220/1.5; 217/43 A

[51] Int. Cl.[2] ..... B65D 7/00; B65J 1/04; B65D 9/12

[58] Field of Search ..... 220/4 F, 1.5, 6, 7; 217/12 R, 13, 15, 43 R, 43 A, 45, 47

[56] References Cited

UNITED STATES PATENTS

| | | | |
|---|---|---|---|
| 3,159,300 | 12/1964 | Coffey, Jr. | 217/43 A |
| 3,387,733 | 5/1968 | Field | 217/12 R |
| 3,446,415 | 5/1969 | Bromley | 220/7 X |
| 3,877,602 | 4/1975 | Clark et al. | 217/43 R X |

*Primary Examiner*—William Price
*Assistant Examiner*—Steven M. Pollard
*Attorney, Agent, or Firm*—Julian Caplan

[57] ABSTRACT

A knock-down container or bin of the type used to transport fruits and vegetables from the field to produce processing and packing plants is molded of plastic and consists of four identical sides and a bottom. When erected, the containers may be stacked. When detached, the sides nest, preferably with the bottom, for transportation and storage. The bottom is square and is flat on top and formed with reticulated reinforcing ribs on the bottom; on each edge is a projecting lip section. Each side has reinforcing ribs on its exterior. The bottom edge of each side is thickened and has spaced projections with a groove above the projections into which fits the projecting lip of one edge of the bottom. At each end of the side is a post, one post being formed with a rabbet and also carrying three vertically spaced fastener elements. The other post is shaped to fill the rabbet and has sockets to receive the fastener elements. The bottom edge of each side has a foot on each end and a foot in the middle to support the bottom above the ground. A skid fits under the feet.

14 Claims, 7 Drawing Figures

KNOCK-DOWN PLASTIC CONTAINER FOR PRODUCE AND THE LIKE

This invention relates to a new and improved molded plastic knock-down container of the type used for transporting produce from the field to food processing and packing locations and for similar purposes. Heretofore, such containers or bins have been fabricated entirely of wood or plywood in permanent form and have not been capable of disassembly.

Accordingly, it is a principal feature of the present invention that the container, hereinafter described in detail, may be disassembled in that it consists of four identical sides and a bottom; and when thus disassembled, the sides may be nested for transportation from the processing plant back to the fields and for storage. The size of the knocked-down containers is approximately one-sixth the size of the assembled containers, and hence space is saved in transportation and storage.

Another feature of the invention is the fact that the container may be easily set up by one man very rapidly. Two sides are joined together by three simple fasteners at each corner which may be engaged using a screwdriver or similar tool. The bottom and the bottoms of the sides have interfitting parts whereby the bottom is supported by the sides and the legs of the sides support the bottom above ground. Conversely the container may be easily disassembled using the same tools and the reverse procedures; and once disassembled, pairs of sides may be nested in compact fashion so that an entire container consisting of bottom and four sides nests together.

Another feature of the invention is the fact that because of the high strength of the walls of the sides the containers may be stacked nine high when filled, each container being approximately 45 inches high. Prior containers have not been capable of stacking so high.

Another feature of the device is the fact that being molded of plastic it is lighter in weight than conventional containers for this purpose. Thus the total empty weight of the container is about 70 lbs., whereas a wooden container of the same capacity is 145 lbs. as a minium. Each side weighs approximately 10 lbs., and the bottom weighs 30 lbs.

Another feature of the invention is economy in transportation. An extra tier of containers may be piled on a truck and still enable the truck to stay within highway load limits.

The present invention is preferably molded of a plastic material such as Profax, a trademark of Hercules Corporation. Such material is impervious to acids and resists heat and cold. It is more resilient and less fragile than wooden containers. When suitably dimensioned and with the choice of proper plastics, the strength of the container is approximately 2½ times the required capability. In addition, the plastic may be formed with an aperture for drainage of liquids such as processing chemicals and juices.

The material from which the device is constructed is capable of a very long life, and since the device is not readily damaged during handling it may be re-used over a number of seasons.

Another feature of the invention is the fact that because of the nature of the material of construction the plastic may be color coded. It will be understood that most containers of this type are owned by canneries and are furnished to growers for filling. By color coding the containers of different owners may be readily distinguished. Further, in the molding of the sides, slugs may be inserted in the molds for imprinting of the name of the owner.

Along each side of the container a replaceable wooden skid is fastened to the bottom of each leg. The skids permit stacking on damp ground. Also, they take the wear when the containers slide over abrasive surfaces and can be replaced when worn.

Still another feature of the invention is the manner in which the bottom is supported above the ground by legs depending from the four sides. There are two legs at each corner of the box and one leg in the middle of each side edge of the box. Hence a fork lift may approach the container from four sides instead of only two sides as when wooden boxes are used.

Another important advantage of the invention is that the outside dimensions of the container may be exactly the same as wooden boxes. Hence the very expensive handling equipment presently used for lifting containers and emptying the same need not be modified or replaced.

Other objects of the present invention will become apparent upon reading the following specification and referring to the accompanying drawings in which similar characters of reference represent corresponding parts in each of the several views.

Figure 1:
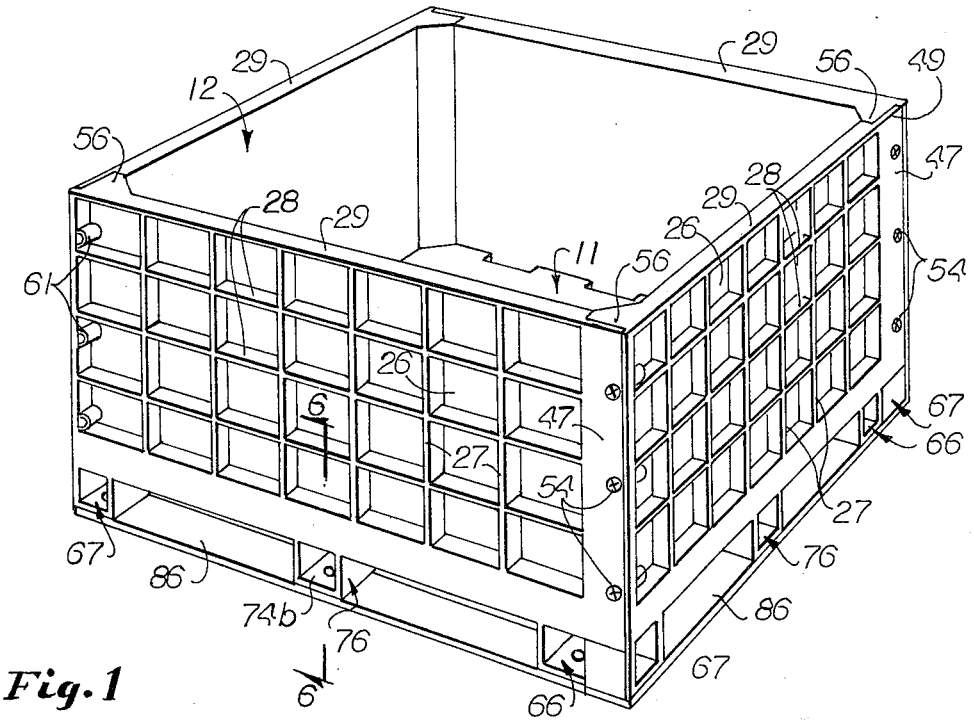
FIG. 1 is a perspective view from above showing the assembled container.
Figure 2:
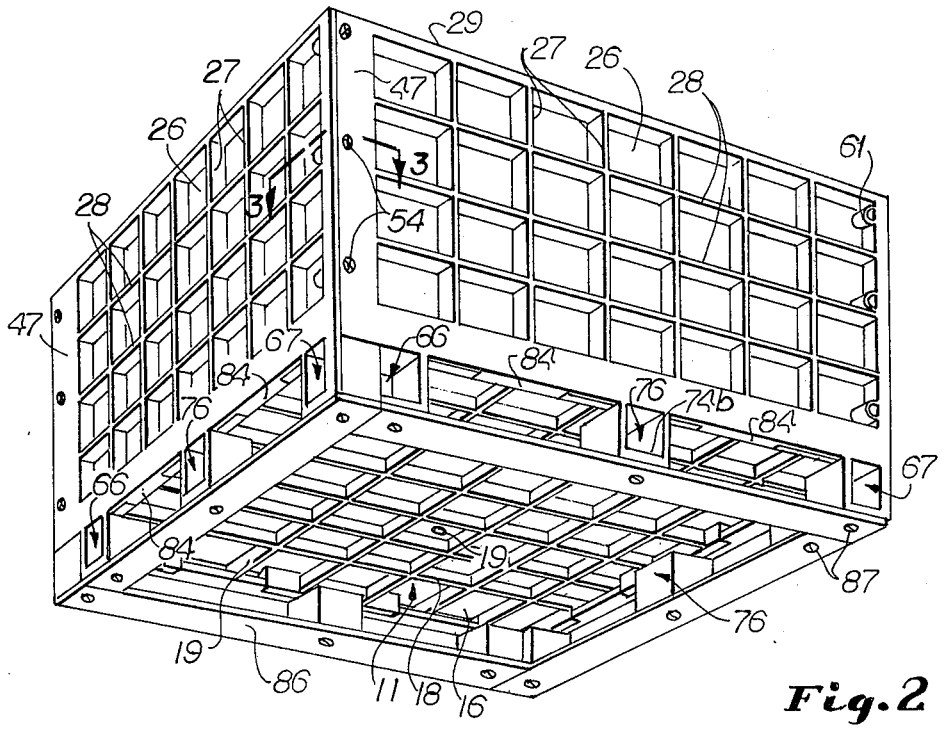
FIG. 2 is a perspective view from below of the assembled container.

The container, which is the subject of this invention, comprises a bottom 11 and four identical sides 12 which interfit and are fastened together to form a unit which may be conveniently assembled and disassembled. The bottom 11 and sides 12 are molded of a plastic material of a type commercially available and known as Profax, a product of Hercules Corporation, it being understood that other plastic materials are also suitable. Other than the five parts mentioned, there are male and female fastener elements holding the sides assembled. A preferred fastener is one commercially available and known as Dzus, a product of Dzus Fastener Co., Inc., illustrated in U.S. Pat. No. 1,955,740, each comprising a stud and a receptacle and characterized by the fact that a mere one-quarter turn of the male fastener element by a screwdriver or other appropriate tool draws the two elements together and locks same and a similar one-quarter turn disengages the two elements, substantially as shown in U.S. Pat. No. 1,955,740.

Bottom 11 is preferably of rectangular shape and sufficiently strong to support the weight of the contents of the container. Accordingly, it comprises a bottom panel 16 which is approximately smooth on the upper surface and is reinforced against deflection on its bottom surface by longitudinal and transverse reinforcing ribs 17, 18, respectively, the ribs being disposed in an approximately square pattern. Panel 16 is formed with a hole 19 for drainage of chemicals and juices. Each edge of panel 16 is formed with projecting lip 21.

Each side 12 comprises a substantially rectangular side panel 26 which is also smooth on its inside surface and is reinforced on its external surface by vertical and horizontal reinforcing ribs 27, 28, respectively, the pattern of ribs preferably being approximately square. The top edge 29 of each side is smooth so that a tier of containers may be stacked.

Figure 3:
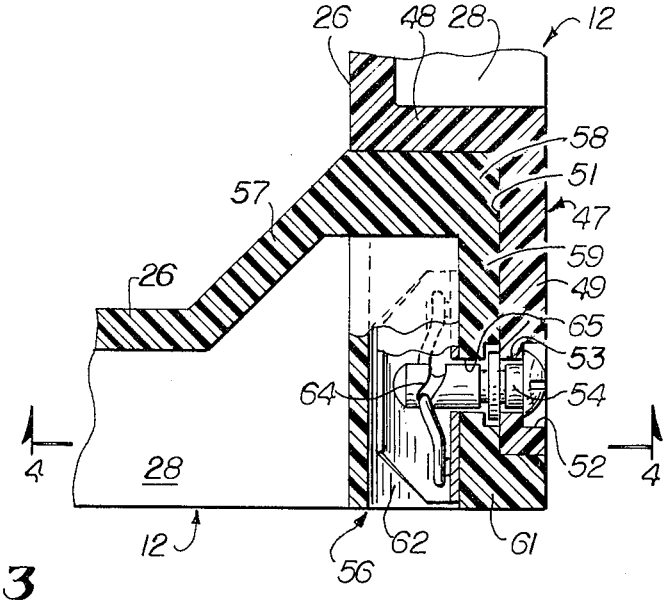
FIG. 3 is an enlarged fragmentary sectional view of a corner taken substantially along the line 3—3 of FIG. 2.

At one end of each side 12 is a first vertical post 47 which, as best shown in FIG. 3, is formed with an outward offset 48 and then an extension 49 which is parallel to, but spaced outwardly of, panel 26. Hence there is a rabbet 51 formed at the first post end of side 12, the end 52 of extension 49 being slightly inwardly disposed relative to the end of the container. A counterbored hole 53 is formed near the outer end of extension 49 to receive male fastener element 54 of the type commercially available and heretofore described.

At one end of side 12 opposite first post 47 is second vertical post 56 which is generally complementary to the rabbet 51. Thus, there is an inward angularly-extending slanted reinforcement wall 57 extending from panel 26 to outward directed inner wall 58 which is flush against offset 58 in the assembled condition of the container as best shown in FIG. 3. Extending outwardly at right angles to wall 58 is side 59 which is flush against the inside of extension 49 and which terminates in an outward offset 61 which fits over end 52. Hollow cylindrical cover 62 is formed on the inside of side 59 opposite hole 53 and secured (as by ultrasonic welding) within cover 62 is the female fastener element 64 which mates with male element 54. Counterbored hole 65 in sidewall 59 provides entry for element 54.

Each side 12 is supported above the ground or an underlying container by three feet, the shape of each of the three feet differing somewhat as next explained. First foot 66 comprises a top 73 which projects inward from panel 26 with a groove 81 between the bottom of panel 26 and top 73, a vertical inner face 69 below top 73, a bottom 74 and inner end 71. A rectangular cross-section boss 34 is located on top of top 73 but there is a gap 82 above boss to receive lip 21. Second foot 67 underlies second post 56 and is similar to foor 66 and the same reference numerals followed by subscript *a* designates corresponding parts. Second foot 67 also has a vertical outer face 68 which is an extension of surface 49 of post 56 and lies against the inside of first foot 66. Foot 66 is set in from end 52 for such purpose.

Third or middle foot 76 resembles foot 66 in shape and function, and the same reference numerals followed by subscript *b* are used to designate corresponding elements.

Between feet 66, 76 and 67 are projections 84 which are longer than projections 34, 34*b* but have the same elevation with the same gap 82 between the top of the projection and the underside of panel 26.

To accommodate wear, a skid 86 underlies each side 12, preferably of wood. A screw 87 attaches to a nut 88 fixed in the bottom 74 of each foot. Thus the skid 86 may be replaced when worn.

Figure 4:
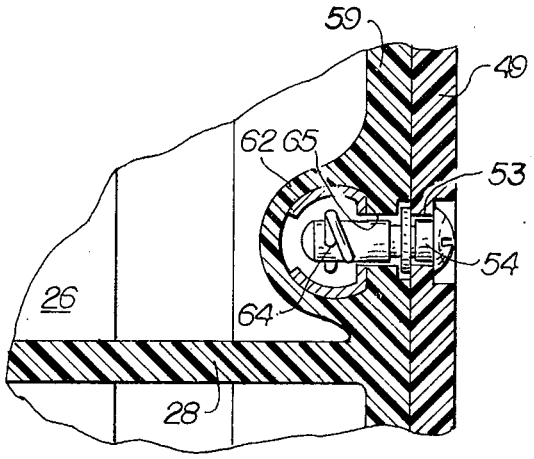
FIG. 4 is a fragmentary sectional view taken substantially along the line 4—4 of FIG. 3.
Figure 6:
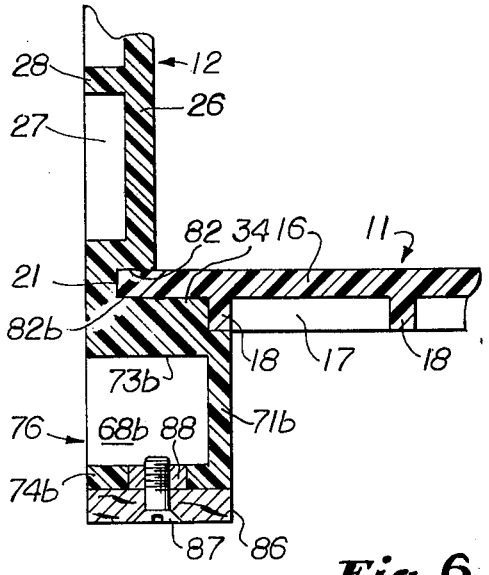
FIG. 6 is a fragmentary sectional view through a side and bottom taken substantially along the line 6—6 of FIG. 5.

To assemble a container, a pair of sides 12 is selected and the second post 56 of one side 12 is fitted into the rabbet 51 of the first post 47 of the other side 12, as best shown in FIG. 3. Each male fastener 54 is turned one-quarter turn by a screwdriver or other implement and this causes the male fastener 54 to lock in the female fastener 64, and in so doing, to draw the parts tightly together in the condition shown in FIGS. 3 and 4. Thereupon, a bottom 11 is selected and placed on top of the projections 34 and top surfaces 73, 73*a*, 73*b* of the feet 66, 67, 76 so that the lip 21 fits into the gap 82 and fills same, as best shown in FIG. 6. The third and fourth sides 12 are then assembled in the same fashion as the first two sides and are fitted over the bottom 11 and again the fasteners 54 are used to attach adjacent sides together. When thus assembled, a rigid structure is provided wherein the bottom 11 is captured within the confines of the four sides 12 and the bottom 11 is supported above the ground by the projections 34, 84. Containers may be filled, lifted by a forklift which easily fits between the legs 66, 67, 76 on top of skid 86 and stacked, all as has been heretofore explained. At destination, the container may be lifted from a truck and handled in the same manner and using the same equipment as standard wooden containers heretofore used.

Figure 7:
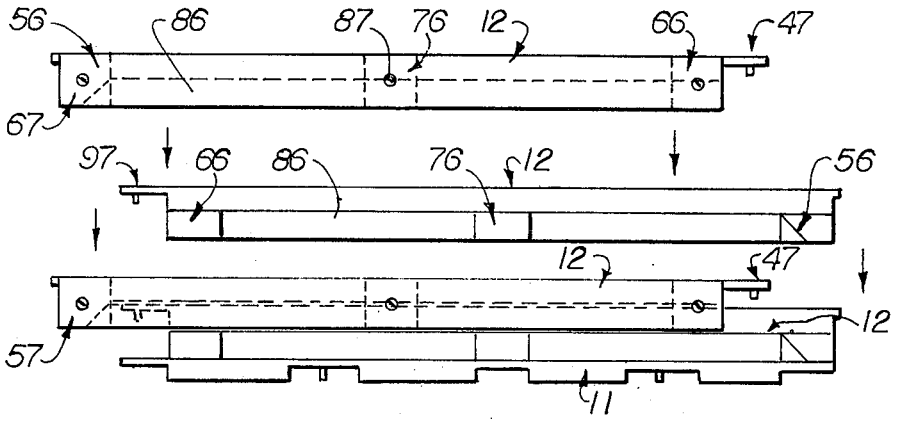
FIG. 7 is an exploded side elevational view showing four sides and a bottom disassembled.
Figure 5:
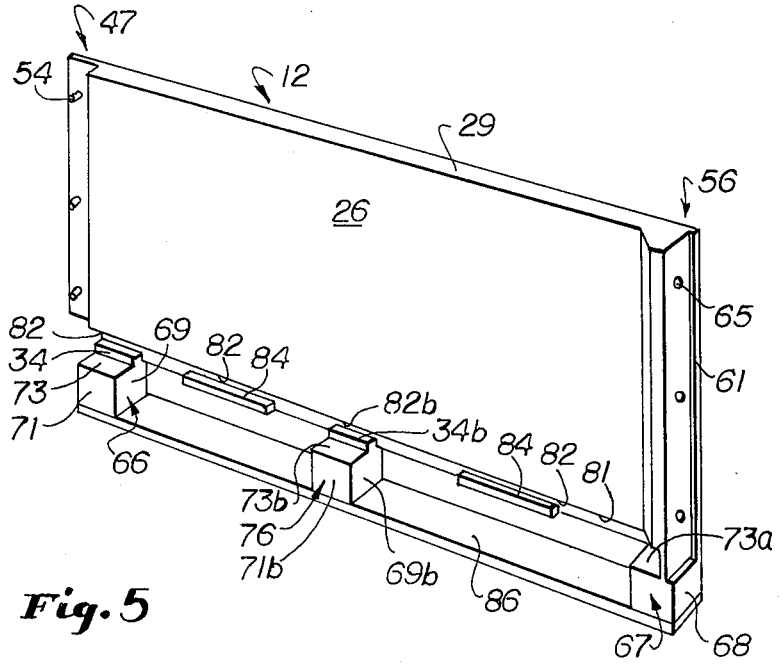
FIG. 5 is a perspective view of a side disassembled.

For storage and transportation, the container is readily disassembled by again turning the male fasteners 54 one-quarter turn, permitting the sides 12 to be disengaged from each other and the bottom 11 dropped. Directing attention to FIG. 7, it will be seen that a pair of sides 12 may be nested together. Each of a pair of sides 12 is turned end to end. Post 47 fits inside post 56. The four sides 12 and a bottom 11 make up a set which fit together compactly.

What is claimed is:

1. A knock-down container comprising a plurality of identical sides and a bottom having side edges corresponding in number to the number of said sides, said sides and bottom being completely separable from each other and when separated being adapted to be stacked flat on top of each other, each said side having a side panel, a first vertical post along one edge, a second vertical post along the edge opposite said first post, a top-reinforced edge, and a bottom reinforced edge, said first post formed with an outwardly offset reentrant first shape providing an inward directed rabbet, said second post formed with a longitudinally and inwardly offset second shape complementary to said rabbet, male and female fastening means in said first and second shapes cooperable with corresponding fastening means of abutting sides to hold said sides assembled edge-to-edge at an angle to each other, first bottom support means on said side edges of said bottom, and second bottom support means on said side edges of said bottom, said first and second bottom support means being located and shaped to interfit and to support said bottom against vertical load by means of said sides, and an end foot on each corner of said container supporting said sides so that said bottom is above the ground, said end foot being an integral downward extension of one of said posts.

2. A container according to claim 1 in which each said side comprises a side panel and a plurality of integral reinforcing ribs on the external surface of said side panel.

3. A container according to claim 1 in which said second shape has an outward projecting offset lying along the outer edge of the first shape of the first post of the abutting side.

4. A container according to claim 1 in which said male fastening means is on said first post and extends inward from a point adjacent the outer edge of said first shape and said second shape comprises a side wall at about a right angle to said side panel and means connecting said side wall to said side panel, said female fastening means being located behind said side wall and said side wall being formed with an aperture so that said male fastening means extends through said aperture to engage said female fastening means.

5. A container according to claim 1 in which said first bottom support means comprises a plurality of inward directed, substantially horizontal projections on said bottom reinforced edge of said side and said second bottom support means comprises a lip on the edge of said bottom.

6. A container according to claim 1 which further comprises a middle foot of substantially rectangular outline in horizontal section formed on the bottom edge of each said side having its lower edge level with the lower edge of said end foot, said middle foot underlying and supporting said side edge of said bottom.

7. A container according to claim 6 which further comprises a skid underlying said side and fastening means attaching said skid to the underside of each said foot.

8. A container according to claim 1 in which said one end foot is formed projecting below and extending inwardly of the bottom edge of said side adjacent one side edge of said side, said one end foot being of substantially rectangular outline in horizontal cross-section, and comprising substantially vertical inner and outer faces perpendicular to said side, and an inner end joining the inner edges of said inner and outer faces.

9. A container according to claim 8 in which the upper surface of said end foot is elevated above the level of said first bottom support and an outer end of said bottom edge of said side is formed with a notch to receive said end foot.

10. A container according to claim 8 which further comprises a second end foot on the end of said side opposite said one end foot, said second end foot comprising a thin downward extension of said side panel extending below said bottom edge of said side the same distance as said one end foot, said second end foot lying against the outer surface of the outer face of the one end foot of an adjacent side.

11. A container according to claim 1 in which a pair of sides nest together in knock-down condition with their side panels parallel and closely adjacent each other, said one end foot of one said side fitting into the rabbet of said first post of the other said side.

12. A container according to claim 11 which further comprises a middle foot formed on the bottom edge of each said side.

13. A container according to claim 1 in which there are four said sides and said bottom is square.

14. A container according to claim 1 in which said fastening means comprises a vertically spaced apart plurality of Dzus fasteners.

* * * * *